United States Patent [19]

Glotz et al.

[11] Patent Number: 4,596,191

[45] Date of Patent: Jun. 24, 1986

[54] TRAINING PROJECTILE

[75] Inventors: Gerhard Glotz; Hansjörg Becker, both of Duesseldorf; Jürgen Boecker, Oberhausen, all of Fed. Rep. of Germany

[73] Assignee: Rheinmetall GmbH, Duesseldorf, Fed. Rep. of Germany

[21] Appl. No.: 657,796

[22] Filed: Oct. 4, 1984

[30] Foreign Application Priority Data

Oct. 4, 1983 [DE] Fed. Rep. of Germany ..... 3335997

[51] Int. Cl.[4] ..... F42B 9/20

[52] U.S. Cl. ..... 102/529; 102/517

[58] Field of Search ..... 102/444–447, 102/498, 501, 517, 529; 244/3.1

[56] References Cited

U.S. PATENT DOCUMENTS 4,228,973 10/1980 Klein ..... 102/501
4,450,769 5/1984 Moser ..... 102/529

FOREIGN PATENT DOCUMENTS 2105445 3/1983 United Kingdom ..... 102/529
2105444 3/1983 United Kingdom ..... 102/529
2115118 9/1983 United Kingdom ..... 102/529

*Primary Examiner*—Harold J. Tudor

[57] ABSTRACT

A supersonic nonspinning training projectile has a projectile body extending along an axis and having axially spaced front and rear ends and an aerodynamic rod projecting axially forwardly from the front end of the body. Thus when the projectile is fired axially forward the rod creates turbulence effective laterally on the projectile body at a wind-attack point which moves axially forward from a rear point to a front point as projectile speed drops. It is possible according to the invention to vary the mass distribution of the projectile and thereby displace the center of mass of the projectile axially between the front and rear points. Thus when the wind-attack point moves axially forward of the center of mass the flight of the projectile destabilizes. Such an arrangement works well even at supersonic speeds, so that the projectile can be set to only fly accurately through a relatively short range, as the principal factor determining range after elevation is projectile speed and shape.

7 Claims, 10 Drawing Figures

TRAINING PROJECTILE

FIELD OF THE INVENTION

The present invention relates to an artillery training projectile. More particularly this invention concerns such a projectile whose effective range can be regulated.

BACKGROUND OF THE INVENTION

Projectiles used for artillery and tank training should have within a limited range a relatively flat trajectory that corresponds to the trajectory of the standard munition that is fired under real combat conditions, but beyond this range the trajectory should break down, with the projectile rapidly losing speed. Thus a wild shot will not pose a danger outside the training field.

This can be done as described in German patent document No. 3,233,045 by providing a short projectile with an axially forwardly projecting rod. This projectile is fired from a rifled barrel so it is stabilized by rotation and leaves the barrel with a supersonic muzzle velocity. The forwardly projecting rod functions aerodynamically at this high speed to prevent turbulence at and around the projectile. As the projectile travels through the air its speed falls off at a rate generally inversely proportional to the distance from the muzzle, and similarly the effectiveness of the aerodynamic rod. Below a certain speed the rod is no longer effective to prevent turbulence from becoming effective on the projectile, thereby causing it to slow rapidly. For a long range the rod is quite long and when the training terrain is limited to a smaller range a shorter rod is used.

In such arrangements the turbulence that is created by the leading end of the rod moves axially until it is at the front face of the spinning projectile and has the above-described braking action. This action is only effective at subsonic speeds, so the minimum range the projectile can be set for is one in which the projectile has slowed from the supersonic muzzle velocity to subsonic speed. As the muzzle velocity for this type of full-caliber projectile is very high, this means that the minimum range will also be fairly long.

OBJECTS OF THE INVENTION

It is therefore an object of the present invention to provide an improved full-caliber training projectile.

Another object is the provision of such a full-caliber training projectile which overcomes the above-given disadvantages, that is which can be set at any range and that is effective even at supersonic speeds.

A further object is to provide an improved method of using such a projectile, one which allows the safety range of the projectile to be set rather easily, right in the field.

SUMMARY OF THE INVENTION

A supersonic nonspinning training projectile according to this invention has a projectile body extending along an axis and having axially spaced front and rear ends and an aerodynamic rod projecting axially forwardly from the front end of the body. Thus when the projectile is fired axially forward the rod creates turbulence effective laterally on the projectile body at a wind-attack point which moves axially forward from a rear point to a front point as projectile speed drops. It is possible according to the invention to vary the mass distribution of the projectile and thereby displace the center of mass of the projectile axially between the front and rear points. Thus when the wind-attack point moves axially forward of the center of mass the flight of the projectile destabilizes since according to this invention the projectile is not stabilized by spin about its own axis. Such an arrangement works well even at supersonic speeds, so that the projectile can be set to only fly accurately through a relatively short range, as the principal factor determining range after elevation is projectile speed and shape.

According to a feature of this invention the mass distribution is changed by means of a set of different masses each releasably securable to the rear end of the body. The masses and body have the same general section and shape. Normally both are cylindrical and the only difference between the masses of a given set is their density.

In such an arrangement the body can have a rearwardly open hollow interior and the masses can each fit therewithin. Although these masses could also be of different densities, it is simpler to make them partially hollow and to vary the radial width and/or axial depth of the hollow interior of the mass to vary its weight.

In accordance with a similar arrangement according to this invention the body has, as mentioned above, a rearwardly open hollow interior and a weight is axially displaceable in this interior to displace the center of mass of the projectile axially between the front and rear points. This means typically includes a screwthread formed on the weight and another screwthread axially nondisplaceable in the body and meshing with the screwthread of the weight in the interior.

The other screwthread can be an internal screwthread formed directly on the body. The rod in this case is rotatable on the body about the axis and there is a rotational coupling between the rod and the weight in the interior. More particularly the weight in the body is formed with an axial passage and the rod is provided in the interior with a rearward extension projecting through the passage. The coupling is a keyway cut in the passage and a key on the extension.

In a different but kinematic arrangement of these parts, the weight in the body is formed with an axial passage and the rod is provided in the interior with a rearward extension projecting through the passage and provided with the other screwthread. Here a rotational coupling constituted as a keyway cut in the weight and a key on the body is provided between the weight in the interior and the body.

The projectile according to this invention is used by first displacing the weight in the interior of the projectile to a position such that the center of mass is positioned to destabilize the flight of the projectile when a predetermined desired speed is reached and then firing the projectile so that its flight destabilizes and it drops once its speed has dropped to the predetermined speed. As described above this range setting can be done simply by rotating the aerodynamic rod, right in the field. The projectile is fired at supersonic speed but without spin.

DESCRIPTION OF THE DRAWING

The above and other features and advantages will become more readily apparent from the following, it being understood that any feature described with reference to only one embodiment of the invention can be used where possible with any other embodiment. In the accompanying drawing.

SPECIFIC DESCRIPTION

Figure 1:
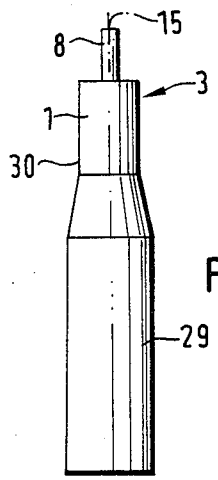
FIG. 1 is a small-scale side view of the training projectile according to the invention.

As seen in FIG. 1 a projectile 3 according to this invention is not stabilized by rotation and generally comprises a projectile body 1 generally centered on an axis 15, a nose rod 8, and a propellant charge 29 secured to the rear end of the body 1. This body 1 is substantially cylindrical and is adapted to be fired from an unrifled barrel. Its outer surface 30 may be provided with the standard seals and its rear end with a gland-type arrangement to ensure maximum propulsion from the charge 29. The external shape of the projectile 3 remains the same according to this invention.

Figure 2:
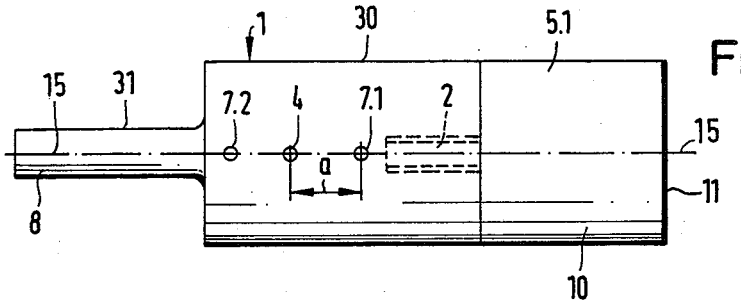
FIG. 2 is a large-scale side view of the projectile.

According to this invention as shown in FIG. 2 the center of mass or gravity of the projectile lies at 4 when the body 1 is extended rearwardly by a mass 5.1 having a cylindrical outer surface identical to the surface 30 and forming the rear face or stern 11 of the projectile. The point of application of the air through which the projectile travels is indicated at 7.1 for the starting supersonic muzzle velocity, and is at 7.2 for lower speeds. With this system, as long as the rear point of application 7.1 lies in the region a in back of the center of mass 4, the nonspinning projectile 3 will fly true, with its axis 15 tangent to its trajectory. When the wind point (air application point) moves forward, relative to the axial travel direction of the projectile, of this center of mass 4, however, the projectile will start to tumble. This will expose the much larger side surfaces 30 and 31 of the body 1 and tip 8 to the wind, causing the projectile to slow markedly. Once the projectile starts to tumble or fly sideways, it will assume a very sharply dropping trajectory as compared to the relative flat trajectory it had while flying axis-on.

According to the invention the mass 5.1 is always of the same shape but can be of different densities or weights. Thus it is possible in effect to move the mass center 4 along the projectile axis 15. Moving it forward lowers the speed at which the projectile will destabilize and therefore increase its range. Hence it is possible to fit the appropriate mass 5.1 to the projectile body 1, as shown here by screwing a threaded stem 2 into the rear of the body 1, and thereby determine the length of the relatively flat part of the trajectory.

Figure 3:
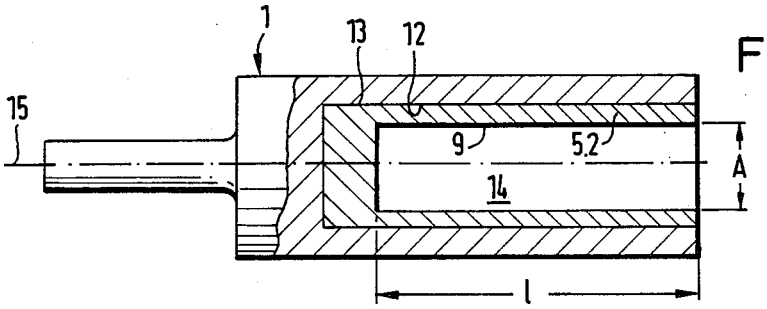
FIGS. 3, 4, 5, and 6 are axial sections through embodiments of this invention.

This effect can also be achieved as illustrated in FIG. 3 by forming the body 1 with a backwardly open recess 13 having a cylindrical surface 12 into which fits an insert mass 5.2. This mass 5.2 in turn has a hollow and backwardly open interior 14 having an inner surface 9 and with a diameter A and axial length 1. By changing these dimensions A and 1 it is possible to vary the mass of the insert 5.1 and thereby move the center of mass 4 of the entire projectile 3.

Figure 4:
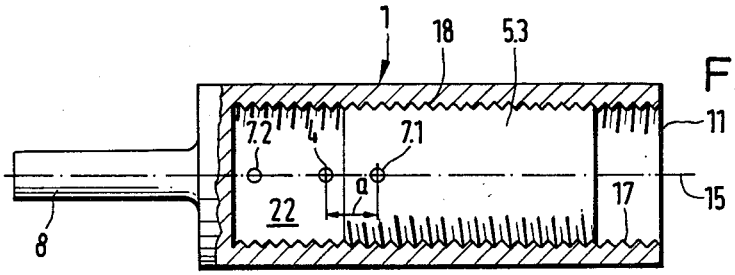

FIG. 4 shows a body 1 formed with a rearwardly open hollow interior 22 formed in turn with an internal screwthread 17 and receiving a cylindrical mass 5.3 having an external screwthread 18 meshing with the thread 17. It is therefore possible by rotating the mass 5.3 in the body 1 to move it axially therein and thereby vary the length of the region a.

Figure 5:
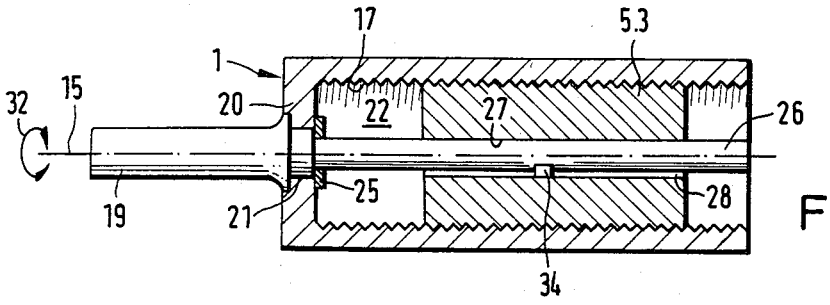

The system of FIG. 5 is substantially the same as that of FIG. 4. Here, however, the weight or mass 5.3 is formed with a central throughgoing bore 27 formed in turn with a radially inwardly open groove or keyway 28 in which rides a key 34 carried on a rearward extension 26 of a pin 19 replacing the pin 8. This pin 19 is journaled for rotation at 21 in the front wall 20 of the body 1 and a snap ring 25 prevents the pin 19 from moving axially relative to the body 1. Thus rotation of the pin 19 as indicated by the arrow 32 will axially displace the mass 5.3 in the interior 22, by screwing it therealong.

Figure 6:
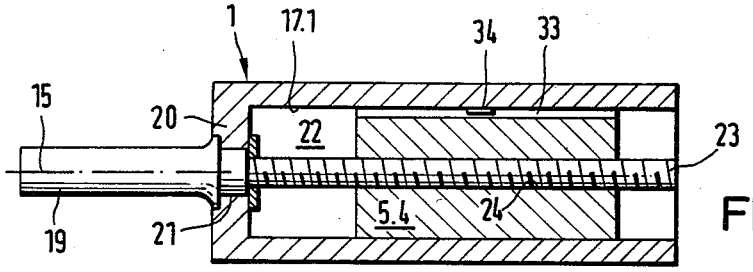

A similar arrangement is shown in FIG. 6, but wherein the mass 5.4 is formed with a threaded bore 24 receiving the threaded extension 23 of the rod 19. A key 34 lodged in the wall 17.1 of the interior 22 rides in an axially extending and radially outwardly open groove 33 of the body 5.4. Operation is identical to that of FIG. 5: rotation of the pin 19 in one direction moves the center of mass of the projectile body 1 axially in one direction and rotation in the opposite direction displaces it axially oppositely. Providing the threads on the rod 23 rather than in the interior 22 means that the body 1 can be produces wholly without machining, thereby bringing down production costs.

The advantage of these systems is that they allow the position of the center of mass to be adjusted just before loading the projectile. Normally they are set at a certain range, and the gunner rotates the rod 19 a certain number of turns in a certain rotational direction to increase or decrease this range.

Figure 7:
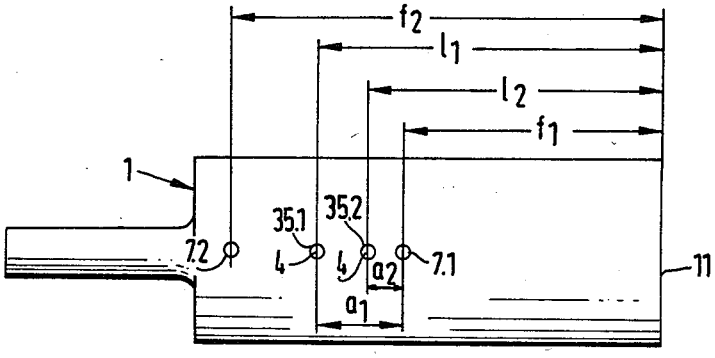
FIG. 7 is a large-scale side view of another projectile in accordance with the invention.

In FIG. 7 $f_1$ and $f_2$ illustrate that the distance between the stern 11 of the body 1 and the respective points of attack 7.1 and 7.2 where the air rushing axially back past will be effective laterally as turbulence are generally fixed for a projectile of given shape. The insert or add-on mass according to this invention can be moved axially however, so that center 4 of mass can be moved easily between points 35.1 and 35.2 at respective distances $l_1$ and $l_2$ from the stern 11 and defining respective long and short regions $a_1$ and $a_2$.

Figure 8:
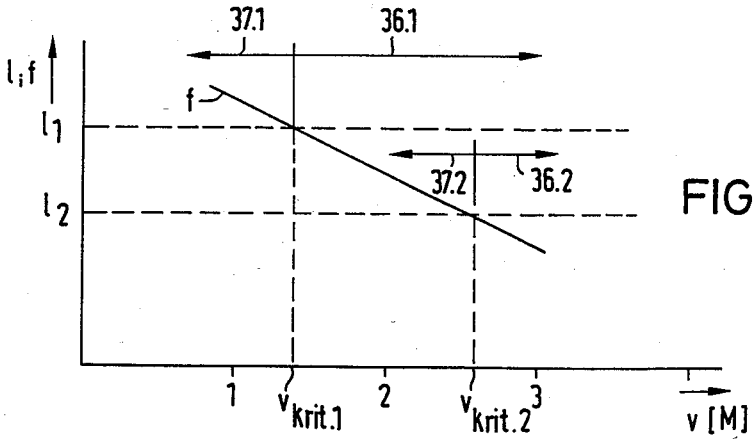
FIG. 8 is a diagram illustrating the stable and unstable flight regions of the training shot with the center of mass in two different positions.

FIG. 8 illustrates that with decreasing speed the spacing f of the wind-attack points 7.1 and 7.2 increases, speed v being plotted on the abscissa and mass spacing 1 on the ordinate. This relationship is achieved through the shape of the tip 8 and is utilized according to this invention in a training shell differing from the known rotation-wing-stabilized projectiles. With a large distance $l_1$ between the center of mass 4 and the stern 11, the region 36.1 of stable flight is substantially greater than the region 36.2 of stable flight with a shorter distance $l_2$. The phase 37.2 of unstable flight follows more rapidly after the shorter stable-flight phase 36.2 with this shorter length $l_2$. When the spacing f is equal to the spacing 1, the projectile destabilizes, hence this is called the critical speed and is identified in FIG. 8 at $v_{krit.1}$ and $v_{krit.2}$ for the two spacings $l_1$ and $l_2$.

Figure 9:
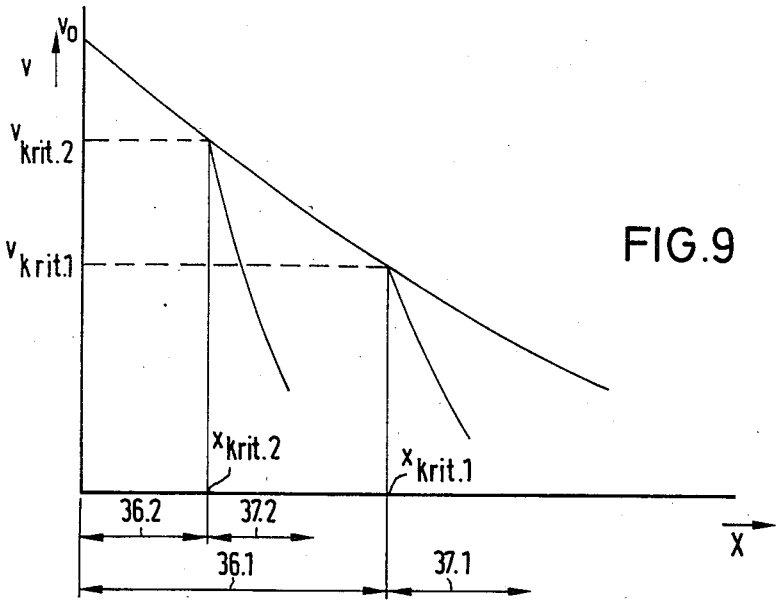
FIG. 9 is a diagram of the speed during stable and unstable flight at two different distances.
Figure 10:
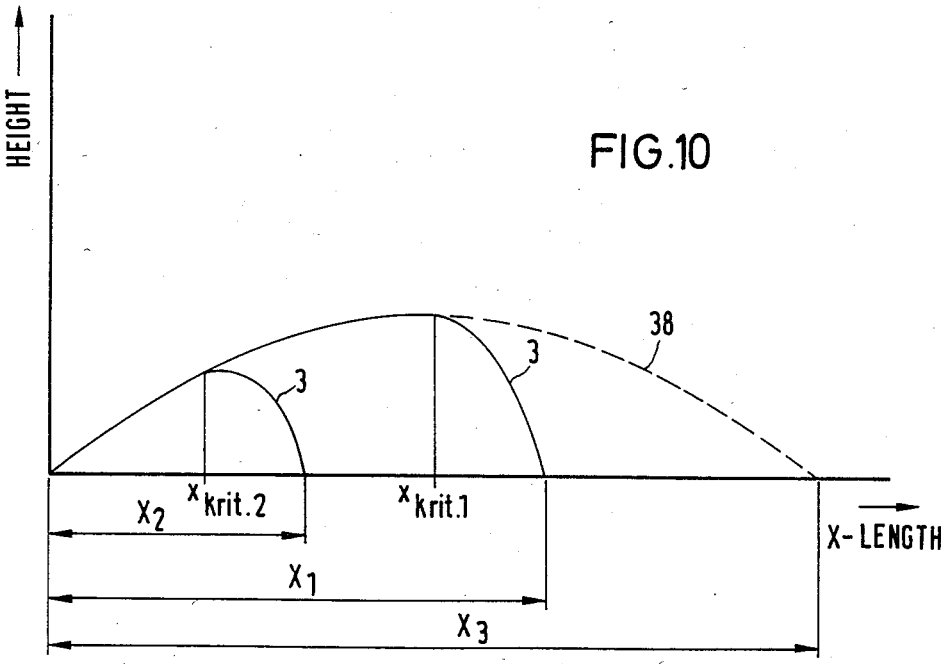
FIG. 10 illustrates the trajectory of the training shell according to this invention compared to standard munitions.

With further reference to FIG. 9 where distance x is plotted on the abscissa and velocity v on the ordinate, the trajectory of the shot drops off markedly, as illustrated, once the projectile has traveled through a predetermined distance $x_{krit.1}$ or $x_{krit.2}$ relative to the velocities $v_{krit.1}$ and $v_{krit.2}$. The critical speed is therefore reached sooner with the length $l_2$. The result as seen in FIG. 10 is that the overall distances $x_1$ and $x_2$ traveled are much shorter than the distance $x_3$ traveled by a standard projectile moving along a uniform trajectory 38. In a standard training situation, as compared to a normal $x_3$ of 5000 m, the distances $x_1$ and $x_2$ would be 3000 m and 1000 m, respectively.

I claim:

1. A supersonic nonspinning training projectile comprising:

a projectile body extending along an axis and having axially spaced front and rear ends and a rearwardly open hollow interior;

an aerodynamic rod projecting axially forwardly from the front end of the body, whereby when the projectile is fired axially forward the rod creates turbulence effective laterally on the projectile body at a wind-attack point which moves axially forward from a rearmost point to a front point as projectile speed drops;

said front end including a front wall and said rod being rotatably but axially immovably mounted in said front wall, a weight axially displaceable in the interior for displacing the center of mass of the projectile axially between the front and rear points prior to launch; and means operatively coupled to said rod for displacing and axially arresting the weight in the interior.

2. The supersonic nonspinning training projectile defined in claim 1 wherein the means includes an external screwhead formed on the weight and another internal screwthread on the body axially meshing with the screwthread of the weight in the interior.

3. The supersonic nonspinning training projectile defined in claim 1 wherein the rod is rotatable on the body about the axis and the means includes an axially displaceable coupling between the rod and the weight in the interior.

4. The supersonic nonspinning training projectile defined in claim 3 wherein the weight in the body is formed with an axial passage and the rod is provided in the interior with a rearward extension projecting through the passage, the rotational coupling being a keyway cut in the passage and a key on the extension.

5. The supersonic nonspinning training projectile defined in claim 2 wherein the means include the weight in the body is with an axial passage having an internal thread and the rod is provided in the interior with a rearward extension projecting through the passage and provided with an external screwthread.

6. The supersonic nonspinning training projectile defined in claim 3 wherein the axially displaceable coupling is a keyway cut in the weight and a key on the body.

7. A method of using a supersonic nonspinning training projectile comprising:

a projectile body extending along an axis and having axially spaced front and rear ends and a rearwardly open hollow interior;

an aerodynamic rod projecting axially forwardly from the front end of the body, whereby when the projectile is fired axially forward the rod creates turbulence effective laterally on the projectile body at a wind-attack point which moves axially forward from a rearmost point to a front point as projectile speed drops;

a weight axially displaceable in the interior for displacing the center of mass of the projectile axially between the front and rear points; and means for displacing and axially arresting the weight in the interior, whereby when the wind-attack point moves axially forward of the center of mass the flight of the projectile destabilizes, the method comprising the steps of sequentially:

immediately before firing displacing the weight in the interior of the projectile to a position such that the center of mass is positioned to destabilize the flight of the projectile when a predetermined desired speed is reached; and firing the projectile, whereby its flight destabilizes and it drops once its speed has dropped to the predetermined speed.

* * * * *